United States Patent [19]

Carella

[11] Patent Number: 4,887,584

[45] Date of Patent: Dec. 19, 1989

[54] TRAINING DEVICE FOR ARCHERY

[76] Inventor: Richard F. Carella, 35572 Strathcona Dr., Mt. Clemens, Mich. 48043

[21] Appl. No.: 934,674

[22] Filed: Nov. 25, 1986

Related U.S. Application Data

[63] Continuation-in-part of Ser. No. 891,863, Jul. 30, 1986, abandoned, which is a continuation-in-part of Ser. No. 848,983, Apr. 7, 1986, abandoned.

[51] Int. Cl.[4] ..... F41B 5/00; A63B 21/02

[52] U.S. Cl. ..... 124/90; 124/88; 272/137; 272/143

[58] Field of Search ..... 124/23 R, 86, 17, 35 R, 124/35 A, 20 R, 88, 90, 80; 272/137, 142, 143, 67, 68, 141, 135; 434/247, 258

[56] References Cited

U.S. PATENT DOCUMENTS

| | | | |
|---|---|---|---|
| 3,462,142 | 8/1969 | Sterndale | 272/143 X |
| 3,529,820 | 9/1970 | Templeton | 272/137 |
| 3,966,204 | 6/1976 | Dubach | 272/68 X |
| 4,026,549 | 5/1977 | Gunn | 272/137 X |
| 4,041,926 | 8/1977 | Troncoso, Jr. et al. | 124/35 A |
| 4,057,246 | 11/1977 | Wilson | 272/137 |
| 4,079,933 | 3/1978 | Everroad | 272/126 X |
| 4,245,840 | 1/1981 | Van Housen | 272/137 |
| 4,251,071 | 2/1981 | Norton | 272/68 X |
| 4,279,601 | 7/1981 | Cobelli | 272/137 X |
| 4,441,707 | 4/1984 | Bosch | 272/125 X |
| 4,478,414 | 10/1984 | Molloy | 272/142 X |
| 4,489,705 | 12/1984 | Larson | 124/35 A |
| 4,544,155 | 10/1985 | Wallenbrock et al. | 272/137 X |
| 4,552,356 | 11/1985 | Brousseau | 272/137 |
| 4,591,150 | 5/1986 | Mosher | 272/137 |
| 4,609,191 | 9/1986 | Remme | 272/137 |

FOREIGN PATENT DOCUMENTS

| | | | |
|---|---|---|---|
| 562787 | 10/1932 | Fed. Rep. of Germany | 272/142 |
| 2917834 | 11/1980 | Fed. Rep. of Germany | 272/137 |
| 434067 | 8/1935 | United Kingdom | 272/142 |

*Primary Examiner*—Randolph A. Reese
*Assistant Examiner*—Peter M. Cuomo
*Attorney, Agent, or Firm*—Brooks & Kushman

[57] ABSTRACT

An archery training device (20) is disclosed for teaching an archer proper muscular control and body positioning. The training device (20) includes a string arm connector (70) that is securable without shifting to the upper arm and forearm of the archer's string arm. A draw force carrying member (72) extends from the string arm connector (70) to an anchor point (54) to position the archer's body on a plane of release that prevents movement which would adversely affect accuracy upon string release during actual shooting. The training device (20) can be used with an actual bow, and is also usable with a front portion (110) and a bow handle (62) to provide a simulated bow force by isometrics. Also, another embodiment of the training device (20) has a front portion (110) with a spring (124) that simulates the bow force between the handle (62) and the string arm connector (70). It is also possible to use the training device (20) to study body reaction movements upon release.

24 Claims, 3 Drawing Sheets

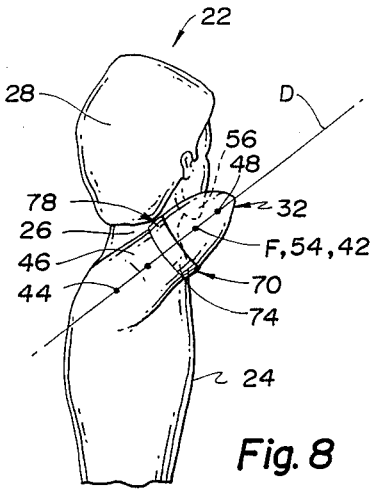
Fig. 8
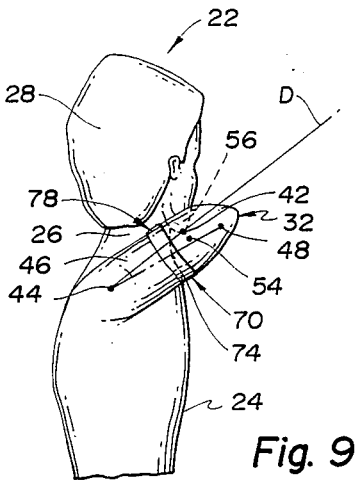
Fig. 9
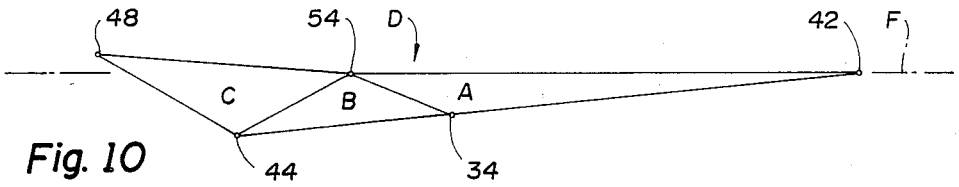
Fig. 10
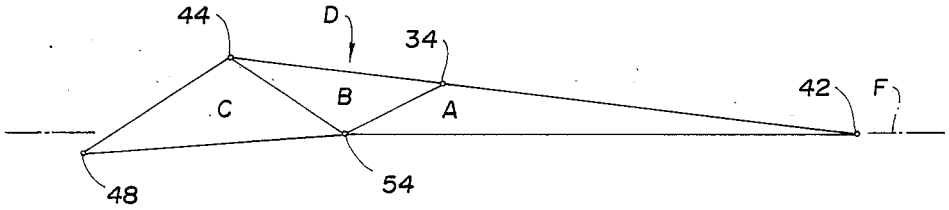
Fig. 11
Fig. 12
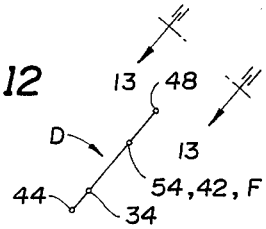
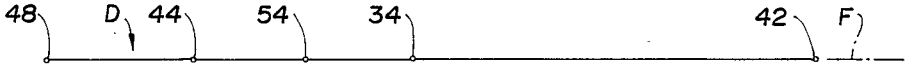
Fig. 13

TRAINING DEVICE FOR ARCHERY

CROSS REFERENCE TO RELATED APPLICATION

This application is a continuation-in-part of prior copending parent application Ser. No. 891,863 which was filed on July 30, 1986, now abandoned, a continuation-in-part of prior copending grandparent application Ser. No. 848,983 which was filed on Apr. 7, 1986, now abandoned.

TECHNICAL FIELD

This invention relates to an archery training device for teaching an archer proper muscular control and body positioning in the drawn stance upon string release for shooting of an arrow.

BACKGROUND ART

Archers have previously recognized an imaginary draw force line along which the bow force is carried between the bow hand and string hand through the anchor point at which the arrow is knocked. However, the full significance of the archer's stance in holding the bow force has not heretofore been fully understood. Rather, the archer's stance in the drawn position has previously been analyzed by what "looks" or "feels" right without appreciating the effect the bow force has on the body upon shooting Thus, the sport of archery has not previously recognized the static and dynamic force considerations involved with shooting nor has there been any recognition of body movements that can cause shooting inaccuracies if the archer is not properly positioned upon string release.

One presently available archery practice device includes a bow handle from which a pair of rubber-like strands extend for attachment to a simulated bow string. This practice device is designed to develop upper body strength and does not teach the archer proper positioning for shooting.

DISCLOSURE OF INVENTION

After over thirty years of being involved in the sport of archery and twelve years of study of muscle anatomy in relationship thereto, I have discovered a concept that facilitates an understanding of the forces involved to permit improvement of shooting accuracy. These forces include the static forces necessary to hold the bow force as well as the dynamic forces necessary to pull the string back to the fully drawn position.

It must be appreciated that even a very slight movement of the bow hand or the anchor point from the intended trajectory can produce significant error in shooting accuracy. For example, competition archery shot at a ninety meter length uses a bull's-eye of approximately 9.6 inches in diameter and, assuming that the bow hand remains stationary, requires that the anchor point where the arrow is knocked be located within a circle whose diameter is only approximately 73 thousandths of an inch. Thus, movement of the anchor point or the bow hand even a very small amount upon arrow release has a substantial effect in shooting accuracy.

The concept which I have developed is termed the "plane of release". An archer properly positioned on the plane of release can statically and dynamically counteract the bow force such that, upon string release, the anchor point and bow hand do not move in a manner that adversely affects shooting accuracy. An understanding of the forces involved with plane of release shooting has also made it possible to develop an archery training device according to the present invention for teaching an archer proper muscular control and body positioning.

The concept I have developed involves positioning three triangles of the archer's stance along a place of release that insures accurate shooting by limiting the bow hand and string hand reactions upon string release to forward and rearward movements, respectively, along the intended trajectory. This plane of release includes a bow arm triangle, a body triangle, and a string arm triangle that must all be coplanar with each other to define the plane of release along which accurate shooting can be executed. All three of these triangles have a common vertex at the anchor point where the arrow is knocked with the bow string. The bow arm triangle is defined by the bow hand, the bow shoulder and the anchor point, while the body triangle is defined by the bow and string arm shoulders and the anchor point, and the string arm triangle is defined by the string arm shoulder, the string arm elbow and the anchor point. These triangles are rotatably positioned with respect to each other about imaginary hinge lines between the anchor point and the shoulders. Positioning of all three triangles about their associated hinge lines so as to be coplanar with each other on the plane of release in the drawn stance provides shooting accuracy that is not otherwise attainable.

Accordingly, one object of the present invention is to provide an archery training device for teaching an archer proper muscular control and body positioning for accurate shooting. Another object of the invention is to provide an archery training device that teaches an archer to move the entire upper body when changing aiming trajectories for different ranges. A further object of the invention is to provide an archery training device that permits bow handle angular adjustment to suit each archer using the device.

In carrying out the above objects, the archery training device of the invention includes a string arm connector that is securable without shifting to the upper arm and forearm of the archer's string arm. A draw force carrying member of the training device extends from the string arm connector to an anchor point to position the archer's bow hand, string arm, shoulders, and the anchor point along a plane of release where the muscles properly hold the bow force with positioning that maintains the bow hand and the anchor point against movement that would adversely affect accuracy upon string release.

Different embodiments of the training device are disclosed as being usable with an actual archery bow that provides the draw force, a bow handle of either a contoured or strap construction for providing the draw force by isometrics, a bow handle that is connected to the anchor point by an elastic spring to provide the draw force, or a connection at the anchor point to permit the training device to be assembled used during actual training or to study the archer's body reactions upon release.

To use each embodiment of the training device, the archer pushes against the bow handle with the bow arm and pulls with the string arm until the anchor point is properly located while the archer's body is loaded with the actual bow draw force, isometric forces, or a spring force that simulates the bow draw force. In the proper position, the bow arm triangle defined by the anchor point and the bow arm shoulder and hand, the body triangle defined by the anchor point and the bow arm and string arm shoulders, and the string arm triangle defined by the anchor point and the string arm shoulder and hand are all located on the plane of release. Loading of the body on the plane of release through "muscle memory" trains the archer to duplicate the proper positioning during actual shooting. Also, the muscles that provide dynamic movement as the arrow is drawn cannot move the body from the correct position on the plane of release without causing movement of the anchor point in a manner that is readily observed by the archer. This also teaches the archer to move the entire body when changing aiming trajectories for different shooting ranges.

In the preferred construction of the training device, the string arm connector includes a pair of loops that are respectively securable to the upper arm and the forearm of the string arm adjacent the elbow. A strap of the training device preferably defines the pair of loops and distributes the force applied to the string arm during use. This strap is constructed to define a slip loop through which the strap itself passes in order to define the pair of loops that are securable to the string arm such that the loading tightens the pair of loops upon use.

In the preferred construction, the draw force carrying member has an adjuster for adjusting the distance between the anchor point and the elbow of the string arm. This draw force carrying member preferably has a cord-like construction, and the adjuster connects the cord-like draw force carrying member to the strap that defines the pair of loops securable to the string arm. As disclosed, the adjuster comprises a U clamp that is tightened to secure the draw force carrying member with the properly adjusted length between the anchor point and the string arm elbow. At the anchor point, the draw force carrying member preferably includes an anchor point connector that is disclosed as being embodied by a hook, such as an S-hook, in each of the embodiments.

One of the disclosed embodiments of the archery training device is used with an archery bow with the anchor point connector secured to the bow string. The actual bow force in this embodiment thus provides the loading with the string arm connector positioning the anchor point in the proper position when the archer's body is on the plane of release as previously described.

Two other embodiments of the training device provide loading of the archer's body by isometrics. Each of these embodiments has the draw force carrying member provided with a front portion extending forwardly from the anchor point and having a simulated bow handle held by the bow hand of the archer. This front portion of the draw force carrying member preferably has a cord-like construction and includes an adjuster that adjusts the length between the anchor point and the bow handle. One of the isometric embodiments has the handle provided with a contoured construction for either a left-hand or right-hand archer, while the other of these embodiments has the handle provided by a strap. Both of the isometric embodiments have the adjuster of the front portion of the draw force carrying member providing the connection thereof to the associated bow handle so as to provide the adjustment of length between the anchor point and the bow handle.

Another embodiment of the training device also has its draw force carrying member provided with a front portion extending forwardly from the anchor point to a bow handle that is held by the bow hand of the archer. In this embodiment, the draw force carrying member includes a spring such as an elasticized rubber-like material, that simulates the bow draw force between the bow handle and the string arm connector. This spring is preferably provided by an elastic member that connects the bow handle to the front portion of the draw force carrying member.

The invention is also disclosed as being embodied by an archery training aid including a hook that is connected by the draw force carrying member to the string arm connector so as to properly locate the archer's body on the plane of release during actual shooting.

The objects, features, and advantages of the present invention are readily apparent from the following detailed description of the best modes for carrying out the invention when taken in connection with the accompanying drawings.

BRIEF DESCRIPTION OF DRAWINGS

FIG. 8 is a rear view taken along the direction of line 8—8 in FIG. 6 to still further illustrate the use of the training device;

FIG. 9 is a rear view taken in the same direction as FIG. 8 to illustrate improper positioning where the string arm is dropped in a manner that is corrected by use of the training device;

FIG. 10 is a schematic side view corresponding to FIGS. 5 and 6 and illustrates bow arm, body, and string arm triangles that are all aligned on a plane of release to give proper shooting as taught by use of the training device;

FIG. 11 is a schematic top view corresponding to FIG. 7 and further illustrates the bow arm, body, and string arm triangles of the plane of release;

FIG. 12 is a schematic rear edge view corresponding to FIG. 8 and further illustrates the plane of release; and FIG. 13 is an inclined edge view taken along the direction of line 13—13 in FIG. 12 to still further illustrate the plane of release.

BEST MODES FOR CARRYING OUT THE INVENTION

Figure 1:
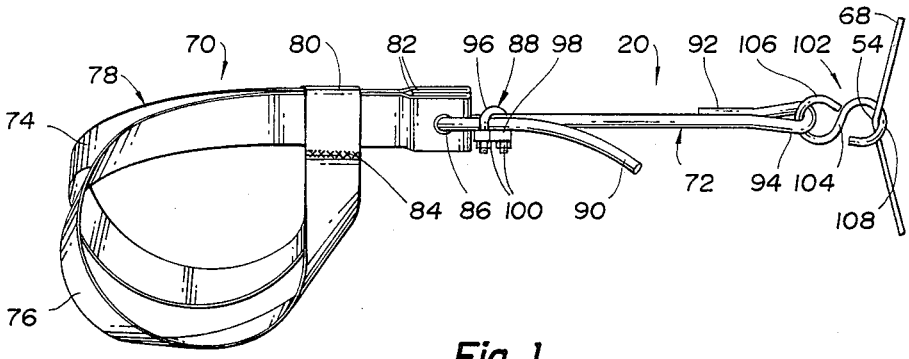
FIG. 1 is a side view of one embodiment of an archery training device that is used with an archery bow and constructed in accordance with the present invention.
Figure 2:
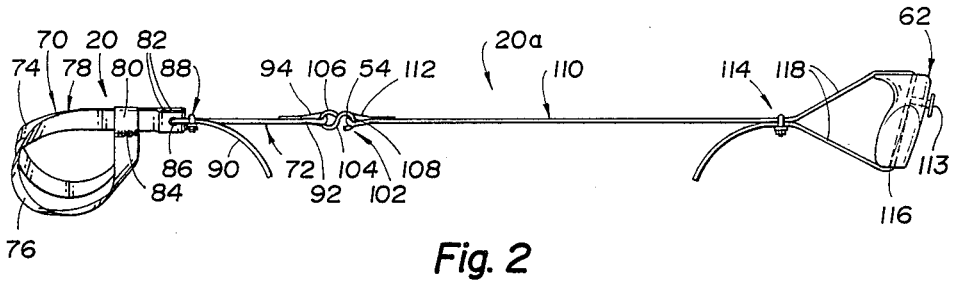
FIG. 2 is a side view of another embodiment of an archery training device constructed in accordance with the present invention and having a contoured bow handle and a string arm connector for loading a draw force carrying member by isometrics.
Figure 3:
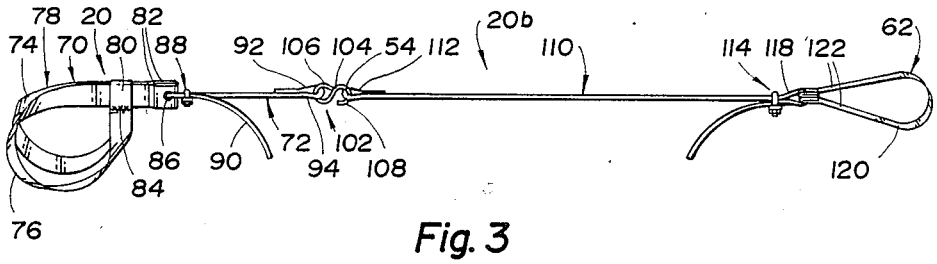
FIG. 3 is a side view of a further embodiment of an archery training device constructed in accordance with the present invention and having a strap bow handle and a string arm connector for loading a draw force carrying member by isometrics.
Figure 4:
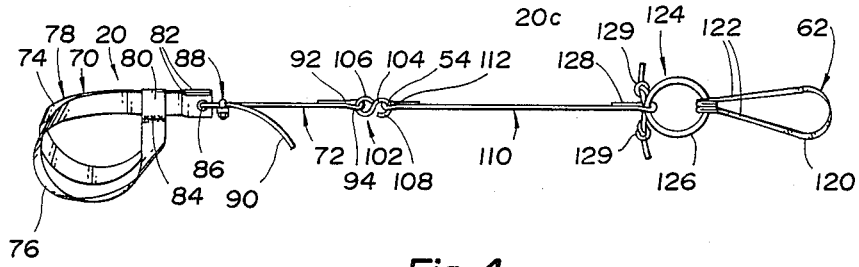
FIG. 4 is a side view of still another embodiment of an archery training device constructed in accordance with the present invention and having a spring that simulates the bow draw force between a bow handle and a string arm connector.
Figure 5:
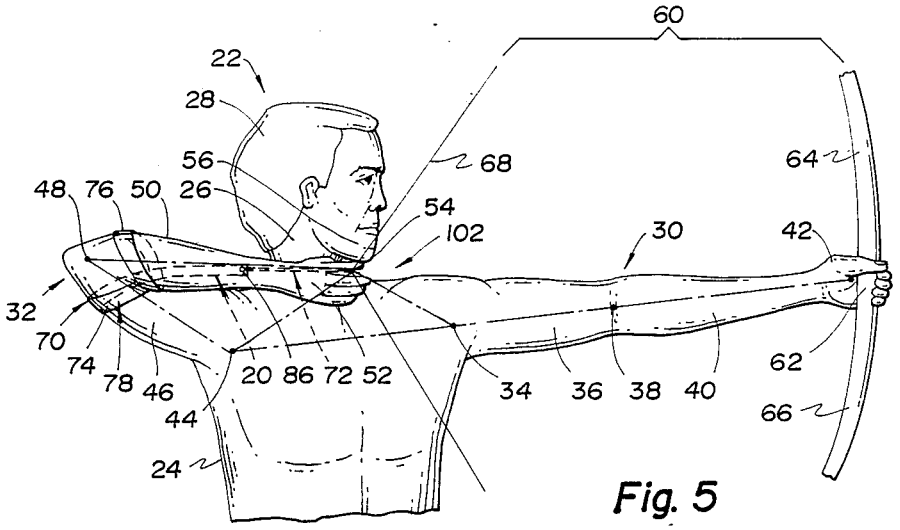
FIG. 5 is a side view of a right-hand archer using the FIG. 1 embodiment of the training device.
Figure 6:
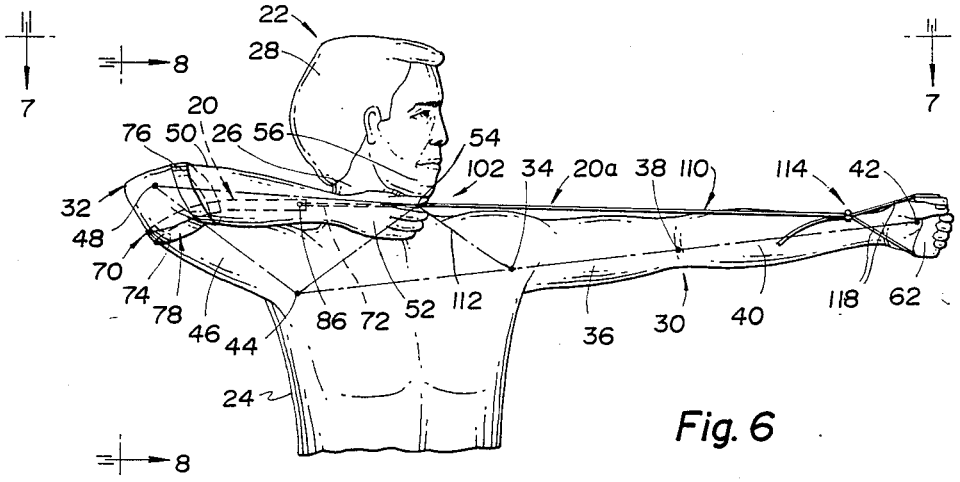
FIG. 6 is a side view of a right-hand archer utilizing the FIG. 2 embodiment of the training device and is also illustrative of the way in which the embodiments of FIGS. 3 and 4 are used.
Figure 7:
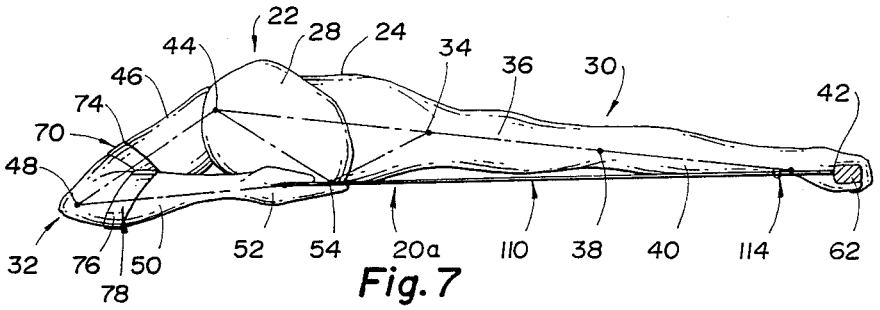
FIG. 7 is a top view taken along line which the training device is used.

One embodiment of an archery training device constructed in accordance with the present invention is identified generally by reference numeral 20 in FIG. 1 and is further illustrated in FIG. 5. Another embodiment 20*a* of the archery training device is illustrated in FIG. 2 and is further illustrated in FIGS. 6, 7, and 8. A further embodiment 20*b* of the training device is illustrated in FIG. 3, and still another embodiment 20*c* of the training device is illustrated in FIG. 4. Each embodiment of the training device teaches an archer proper positioning to prevent inaccuracies in shooting such as will result with the string arm positioned too low as shown in FIG. 9. An understanding of the concept that resulted in development of the training device is facilitated by the schematic views of FIGS. 10 through 13 which illustrate a plane of release positioning that provides accurate shooting.

Before describing the construction of each embodiment of the archery training device, it is necessary to understand the plane of release concept whose development was the genesis of this invention. For an understanding of this plane of release concept, it is necessary to first make reference to the archer's body parts as illustrated in FIGS. 5 through 8 so that the elements of the plane of release can be defined. The archer 22 illustrated in FIGS. 5 and 6 has a torso or body 24 on which the neck 26 supports his head 28 between the forwardly projecting bow arm 30 and bent string arm 32. The bow arm 30 extends from the bow shoulder 34 and includes an upper arm 36, an elbow 38, a forearm 40, and a bow hand 42 for holding the bow during shooting. The string arm 32 extends from the string shoulder 44 and has an upper arm 46, an elbow 48, a forearm 50 that is bent forwardly at the elbow, and a string hand 52 located at a simulated knocking or anchor point 54 where the arrow is knocked with the bow string adjacent the neck 26 and chin 56.

The plane of release concept I have developed can best be understood by combined reference to FIG. 5 through 9 showing the archer 22 and to the schematic views of FIGS. 10 through 13. The bow shoulder 34, bow hand 42, and anchor point 54 in archery define an archer's bow arm triangle identified as A in FIGS. 10 and 11. Bow shoulder 34, string shoulder 44, and anchor point 54 define the archer's body triangle which is identified as B in the schematic views of FIGS. 10 and 11. Furthermore, string shoulder 44, the string arm elbow 48, and the anchor point 54 at which the string hand 52 is located define a string arm triangle that is identified as C in the schematic views of FIGS. 10 and 11. Bow arm triangle A, body triangle B, and string arm triangle C when properly positioned define a single plane of release D best illustrated in FIGS. 8, 12, and 13. Also, in this plane of release, the shoulders 34 and 44 form a straight line with the bow hand 42 when the draw length is correct.

With the archer positioned so that the bow arm triangle A, body triangle B, and string arm triangle C are along the plane of release D, the bow force is held by the archer's body between the bow hand 42, and the string hand 52 at the anchor point 54 along a bow and body force line F which lies on the plane of release D as shown in FIGS. 8 and 10 through 13. With this positioning, the bow force does not tend to move the bow hand 42 or string hand 52 at the anchor point 54 from alignment with the intended trajectory of the arrow. Upon string release with the archer using proper muscle control in the plane of release positioning, the bow force is instantaneously removed from the archer's body and the body reaction is forward and rearward movements of the bow and string hands 42 and 52 along the intended trajectory line F which then constitutes a reaction line.

Without the positioning on the plane of release, the bow hand 42 and/or string hand 52 tend to move vertically or horizontally from the intended trajectory upon shooting and thereby adversely affect shooting accuracy. This results when the bow arm triangle A is rotated with respect to the body triangle B about the hinge line between anchor point 54 and bow arm shoulder 34 so as to be off the plane of release, and when the string arm triangle C is rotated with respect to the body triangle B about the hinge line between anchor point 54 and string arm shoulder 44 so as to be off the plane of release.

If the string arm is positioned below the plane of release as shown in FIG. 9, the resultant force tends to move the anchor point away from the neck and chin upon string release. Furthermore, if the string arm is positioned above the plane of release, the resultant force tends to move the anchor point toward the neck and chin upon string release. Likewise, if the body is rotated counterclockwise from the position of FIGS. 7 and 11, the bow shoulder 34 is positioned off the plane of release D such that the bow arm triangle A is not coplanar with the body triangle B while the string arm triangle C may or may not be coplanar with the body triangle B. Upon string release from this position, the body pivots clockwise as viewed in FIGS. 7 and 11 and the bow handle 42 moves toward the left from the intended trajectory of the arrow. As previously mentioned, even a very small amount of movement caused by the resultant force due to positioning off the plane of release will introduce shooting inaccuracy.

With reference to FIGS. 1 and 5 of the drawings, the embodiment 20 of the archery training device shown in FIG. 1 is utilized with a bow 60 as shown in FIG. 5. Specifically, the bow handle 62 is held by the bow hand 42 with the upper and lower bow limbs 64 and 66 projecting vertically from the handle to attach the upper and lower ends of the bow string 68 which is secured by the training device 20 at the anchor point 54. Training device 20 includes a string arm connector 70 that is securable without shifting to the upper arm 46 and forearm 50 of the string arm 32. A draw force carrying member 72 extends from the string arm connector 70 to the anchor point 54 to carry the bow force between the string arm elbow 48 and the bow hand 42 as shown in FIG. 5. Any movement of the archer's body 24 from the plane of release in the drawn position of FIG. 5 will tend to move the anchor point 54 from its proper location which is observable by the archer who can then correct the error. Thus, the archer's muscles properly hold the bow force with positioning that maintains the bow hand 42 and the anchor point 54 against movement that would adversely affect accuracy upon string release during actual shooting.

In the preferred construction of the training device 20 as shown in FIG. 1, the string arm connector 70 includes a pair of loops 74 and 76 that are respectively securable to the upper arm 46 and forearm 50 of the string arm 32 adjacent the elbow 48. The string arm connector 70 preferably includes a strap 78 that defines the pair of string arm loops 74 and 66 in order to distribute the bow draw force on the string arm during use. This strap 78 is most preferably woven from synthetic resin fibers so as to be durable without soiling. A slip loop 80 provided by strap 78 has double ends 82 of the strap passing therethrough in order to define the pair of string arm loops 74 and 76. This slip loop 80 is provided by securing strap portions to each other at 84, preferably by heat welding the strap portions which are made of thermoplastic fibers that permit such heat securement. Adjacent the attachment of the string arm connector 70 to the draw force carrying member 72, the strap ends 82 are folded back inwardly adjacent each other to provide four strap layers through which a hole 86 is provided in order to reinforce the attachment to the draw force carrying member.

As illustrated by continuing reference to FIG. 1, the draw force carrying member 72 has an adjuster 88 that adjusts its length in order to locate the anchor point 54 at the proper distance from the string arm elbow of the archer using the training device. The draw force carrying member 72 preferably has a flexible cord-like construction having one end 90 that is passed through the strap end hole 86 of the string arm connector 70 to permit adjustable securement at that location by the first adjuster 88. Another end 92 of the cord-like draw force carrying member 72 is secured to itself to provide an anchor point connector loop 94 with this securement preferably being provided by heating of thermoplastic synthetic resin fibers from which the draw force carrying member is made.

As illustrated in FIG. 1, the first adjuster 88 is embodied by a U clamp having a U-shaped clamp member 96 and a bar clamp member 98 that extends between the legs of the U-shaped clamp member to capture the two strands of the draw force carrying member 72 adjacent its end 90 which passes through the string arm connector strap hole 86. A pair of nuts 100 secure the bar clamp 98 to threaded ends on the legs of the U-shaped clamp member 96 to tightly grip the two strands of the cord-like end 90 of the draw force carrying member 72 after appropriate adjustment to provide the correct distance between the anchor point 54 and the string arm elbow.

It should be appreciated that other constructions of the first adjuster 88 are possible. For example, it is possible to utilize a number of half hitch knots of the cord-like draw force carrying member 72 so as to eliminate the need for a separate component. Likewise, it is also possible for the adjuster to include a clamp having a U-shaped clamp member whose legs have outer threaded surfaces generated about a concentric axis in a spaced relationship to each other, with a bar clamp member that is received between the threaded legs to provide clamping action under the control of a single nut that is received by both threaded legs. Similarly, other constructions of the adjuster are possible.

At the opposite end of the draw force carrying member 72 from the first adjuster 88, the training device 20 includes an anchor point connector 102. Preferably, the connector 102 is embodied by hook 104 such as an S-hook having a closed loop 106 that receives the connector loop 94 of the draw force carrying member 72 to provide the attachment to the string arm connector 70. A slightly opened loop 108 of the S hook 104 permits the bow string 68 to be connected thereby for use as previously described.

Each of the embodiments **20*a*, 20*b*, and 20*c* respectively illustrated in FIGS. 2, 3, and 4, includes the same construction of the training device 20 illustrated in FIG. 1 and also has its draw force carrying member 72 provided with a front portion 110 extending forwardly from the anchor point 54 and having a simulated bow handle 62 as opposed to being used with an actual bow in the manner previously described. Thus, each of these embodiments 20*a*, 20*b*, and 20*c* can be compactly stored and, in addition to being usable with an actual bow by use of its training device 20**, can be used to permit training without the size involved with carrying an actual bow.

Both of the embodiments **20*a* and 20*b* as respectively illustrated in FIGS. 2 and 3 provide training of an archer along the plane of release by the use of isometrics, i.e. the muscles of the body working against each other in simulating the bow force. Both of the embodiments 20*a* and 20*b* have the front portion 110 of the draw force carrying member provided with a cord-like construction having a rear end formed into a connection loop 112 that receives the opened loop 108 of the anchor point connector hook 104. The front portion 110 of the draw force carrying member 72 extends forwardly from the anchor point 54 and has a second adjuster 114 that adjusts the length between the anchor point 54 and the bow handle 62**.

In the embodiment **20*a* of the training device illustrated in FIG. 2, the bow handle 62 includes a contoured handle surface 116 that is constructed like the handle of either a left-hand or right-hand bow handle. A vertical hole through the handle 113 of this embodiment receives a connection loop 118 at the forward end of the front portion 110 of the draw force carrying member. A suitable threaded positioner 63 in the handle 62 can be used to lock the position of the connection loop 118 with respect to the handle 62 after appropriate adjustment of the length of the cord-like front portion 110 between the anchor point 54 and the handle. A second adjuster 114 that provides such length adjustment preferably has a U clamp construction like the second adjuster 88 previously described and thus includes a U-shaped clamp member, a bar clamp member, and a pair of nuts received by threaded legs of the U-shaped clamp member such that the bar clamp member 98 clamps both strands of the connection loop 118**.

As shown in FIG. 3, the embodiment **20*b* of the training device has its front portion 110 provided with the same construction as the embodiment 20*a* of FIG. 2 except for the bow handle 62 which is provided by a strap 120 whose ends 122 are folded back and provided with a hole through which the connection loop 118 extends to permit adjustable securement by the second adjuster 114. This strap embodiment of the bow handle 62** can thus be used by either left-hand or right-hand archers without the need for a different construction for each one.

With reference to FIG. 4, the embodiment **20*c* of the training device has the front portion 110 of the draw force carrying member provided with a spring 124 that simulates the bow draw force. With this construction, the bow handle 62 must be closer to the anchor point 54 in order to permit extension of the spring 124 during use of the training device to provide the bow force simulation. As disclosed, the spring 124 is embodied by an elastic member 126 that connects the ends 122 of the strap 120 providing the bow handle 62 with the forward end of the front portion 110 of the draw force carrying member. As disclosed, the forward end of the front portion 110 is provided with a connection loop 128 and the elastic member 126 is embodied by surgical tubing that forms a loop passing through the apertured ends 122 of the chord of strap handle 120 and through the connection loop 128 with knotted ends 129** maintaining the connection.

USE OF TRAINING DEVICE

Each embodiment is utilized as illustrated in FIGS. 6 through 9 as the archer holds the associated bow handle 62 with the bow hand 42 with the string arm connector 70 secured to the string arm 32 as previously described in a manner that prevents shifting adjacent the elbow 48. The archer 22 extends the bow arm 30 so as to align the bow hand 42 with shoulders 34 and 44 and also bends the string arm 32 to the shooting position until the anchor point 54 is located adjacent the archer's neck 26 and chin 56 as illustrated. In this position, the bow arm triangle A, body triangle B, and string arm triangle C illustrated in FIGS. 10 and 11 are all located along the plane of release D shown in FIGS. 12 and 13. The bow draw force is then transmitted along the force line F on the plane of release D. If the tensioned draw force carrying member 72 were then instantaneously cut, the archer's bow hand 42 would react by moving forwardly along the force line F on the plane of release D. At the same time, the string arm hand 52 would move rearwardly along the force line F on the plane of release D. Since no adverse resultant force or body rotation results, there is no movement from the plane of release in a manner that can adversely affect shooting.

It should be noted that the string arm 32 cannot move above or below the plane of release when using the training device without movement of the anchor point 54 so as to give the archer an indication that the positioning is improper. Specifically, if the string arm 32 is moved above the plane of release D, the string arm connector 70 tends to bend around the anchor point 54 and exert pressure on the neck 26 and/or chin 56. Similarly, if the string arm 32 drops below the plane of release D, the anchor point 54 tends to move away from the neck 26 and chin 56 which is also observable by the archer. The anchor point 54 also moves away from the neck and chin if the bow shoulder is located off the plane of release in a manner that produces body rotation upon shooting. Such movement of the anchor point when using the training device also teaches the archer to move the entire upper body when aiming for differing ranges of shooting requiring trajectories having varying angles of assent. Thus, the archery training device teaches the archer proper muscular control and body positioning for accurate shooting in a manner that was not heretofore possible.

While the best modes for carrying out the invention have been described in detail, those familiar with the art to which this invention relates will recognize various alternative designs and embodiments for carrying out the invention as defined by the followings claims.

What is claimed is:

1. An archery training device for teaching an archer proper muscular control and body positioning, the training device comprising: a string arm connector located adjacent the elbow of the string arm, said string arm connector including a slip loop and defining a pair of loops connected to the slip loop for positioning above and below; one loop of the pair of loops being securable to the upper arm of the archer'string arm proximate the elbow for tightening under tension; the other loop of the loops being securable to the forearm of the archer'-string arm proximate the elbow for tightening under tension; said pair of loops cooperating together with said slip loop upon tightening under tension to prevent shifting of the string arm connector with respect to the upper ar and forearm proximate the elbow of the string arm; and a draw force carrying member extending forwardly from the string arm connector toward an anchor point such that the device aids in positioning the archer'bow hand, string arm, shoulders, and the anchor point along a plane of release where the muscles properly hold the bow force with positioning that maintains the bow hand and the anchor point against movement that would adversely affect accuracy upon string release during actual shooting.

2. An archery training device as in claim 1 wherein the string arm connector includes a strap that defines the pair of loops.

3. An archery training device as in claim 2 wherein the strap defines and slip loop through which the straps passes to define the pair of loops which, upon tightening under tension, cooperate together with said slip loop to secure the string a connector to the string arm snugly, distributing the tension of the string arm connector between the archer'upper string arm and forearm proximate the elbow.

4. An archery training device as in claim 3 wherein the draw force carrying member has a first adjuster for adjusting the distance between the anchor point and the string arm elbow.

5. An archery training device as in claim 4 wherein the draw force carrying member has a cord-like construction, and the first adjuster connects the cord-like draw force carrying member to the strap that defines the pair of loops that are securable to the string arm.

6. An archery training device as in claim 4 or 5 wherein the first adjuster comprises a U clamp.

7. An archery training device as in claim 5 wherein the draw force carrying member includes an anchor point connector.

8. An archery training device as in claim wherein the anchor point connector comprises a hook.

9. An archery training device as in claim 1, 3, 5 or 8 wherein the draw force carrying member has a front portion extending forwardly from the anchor point and has a bow handle held by the bow hand of the archer.

10. An archery training device as in claim 9 wherein the front portion of the draw force carrying member has a cord-like construction and includes a second adjuster that adjust the length between the anchor point and the handle.

11. An archery training device as in claim 10 wherein the handle has a contoured construction, and wherein the second adjuster of the front portion of the draw force carrying member provides connection thereof to the contoured handle.

12. An archery training device as in claim 10 wherein the handle includes a strap, and wherein the second adjuster of the front portion of the draw force carrying member provides connection thereof to the strap of the handle.

13. An archery training device as in claim 12 wherein the strap comprises an elastic-like material which extends under tension, and upon release, returns to its relaxed dimensions.

14. An archery training device as in claim 10 wherein the draw force carrying member includes a spring that simulates the bow draw force.

15. An archery training device as in claim 14 wherein the spring comprises an elastic member that connects the handle to the front portion of the draw force carrying member.

16. An archery training device as in claim 9 wherein the bow handle includes a passage through which the front portion extends, and a threaded positioner mounted perpendicularly to the passage which secures the front portion withing the passage.

17. An archery training device for teaching an archer proper muscular control and body positioning, the training device comprising: a string arm connector located adjacent the elbow of the string arm said string arm connector including a slip loop and defining a pair of loops connected to the slip loop for positioning above and below the elbow; one loop of the pair of loops being securable to the upper arm of the archer'string arm proximate the elbow of tightening under tension; the other loop of the pair of loops being securable to the forearm of the archer'string arm proximate the elbow for tightening under tension; said loops cooperating together with said slip loop upon tightening under tension to prevent shifting of the string arm connector with respect to the upper arm and forea proximate the elbow of the string arm; a draw force carrying member extending forwardly from the string arm connector; a bow handle connected to the draw force carrying member; and a first adjuster for adjusting the length of the draw force carrying member between the string arm connector and the bow handle to position the archer'bow hand, string arm, shoulders, and a simulated anchor point along a plane of release where the muscles properly hold the bow force with positioning that maintains the bow hand and the anchor point against movement that would adversely affect accuracy upon string release during actual shooting.

18. An archery training device for teaching an archer proper muscular control and body positioning, the training device comprising: a string arm connector located adjacent the elbow of the string arm said string arm connector including a strap having a slip loop through which the strap extends and defining a pair of loops connected to the slip loop for positioning above and below the elbow; one loop of the pair of loops being securable to the upper arm of the archer'string arm proximate the elbow for tightening under tension; the other loop of the pair of loops being securable to the forearm of the archer'string arm proximate the elbow for tightening under tension; said loops cooperating together with said slip loop upon tightening under tension to prevent shifting of the string arm connector with respect to the upper arm and forearm proximate the elbow of the string arm; and a draw force carrying member extending forwardly from the string arm connector toward an anchor point to position the archer'bow hand, string arm, shoulders, and the anchor point along a plane of release where the muscles properly hold the bow force with positioning that maintains the bow hand and the anchor point against movement that would adversely affect accuracy upon string release during actual shooting.

19. An archery training device for teaching an archer proper muscular control and body positioning, the training device comprising: a string arm connector located adjacent the elbow of the string arm, said string arm connector including a strap having a slip loop through which the strap extends to provide a pair of loops connected to the slip loop for positioning above and below the elbow; one loop of the pair of loops being securable to the upper arm of the archer'string arm proximate the elbow for tightening under tension; the other loop of the pair of loops being securable to the forearm of the archer'string arm proximate the elbow for tightening under tension; said loops cooperating together with said slip loop upon tightening under tension to prevent shifting of the string arm connector with respect to the upper arm and forearm proximate the elbow of the string arm; a draw force carrying member extending from the string arm connector and has an anchor point connector; a first adjuster that adjusts the length of the draw force carrying member between the string arm connector and the anchor point connector; the draw force carrying member having a front portion that extends forwardly from the anchor point; and a bow handle connected to the front portion of the draw force carrying member such that the training device positions the archer'bow hand, string arm, shoulders, and the anchor point along a plane of release where the muscles properly hold the bow force with positioning that maintains the bow hand and the anchor point against movement that would adversely affect accuracy upon string release during actual shooting.

20. An archery training device for teaching an archer proper muscular control and body positioning, the training device comprising: a string arm connector located adjacent the elbow of the string arm and string arm connector including a string having a slip loop through which the strap extends and defining a pair of loops connected to the slip loop for positioning above and below the elbow; one loop of the pair of loops being securable to the upper arm of the archer'string arm proximate the elbow for tightening under tension; the other loop of the pair of loops being securable to the forearm of the archer'string arm proximate the elbow for tightening under tension; said loops cooperating together with said slip loop upon tightening under tension to prevent shifting of the string arm connector with respect to the upper arm and forearm proximate the elbow of the string arm; a draw force carrying member extending rearwardly from an anchor point to the string arm connector; a first adjuster that secures the draw force carrying member to the string arm connector and adjusts the length of the draw force carrying member between the anchor point and the string arm connector; an anchor point connector secured to the draw force carrying member at the anchor point; the draw force carrying member having a front portion that extends forwardly from the anchor point connector; a bow handle to which the front portion of the draw force carrying member extends; and a second adjuster that adjustably secures the bow handle to the front portion of the draw force carrying member to adjust the length thereof between the anchor point connector and the bow handle such that the training device positions the archer'bow hand, string arm, shoulders, and the anchor point along a plane of release where the muscles properly hold the bow force with positioning that maintains the bow hand and the anchor point against movement that would adversely affect accuracy upon string release during actual shooting.

21. An archery training device as in claim 20 wherein the bow handle has a contoured construction.

22. An archery training device as in claim 20 wherein the bow handle comprises a strap.

23. An archery training device for teaching an archer proper muscular control and body positioning, the training device comprising: a string arm connector located adjacent the elbow of the string arm, said string arm connector including a strap having a slip loop through which the strap extends to provide a pair of loops connected to the slip loop for positioning above and below the elbow; one loop of the pair of loops being securable to the archer'string arm proximate the elbow for tightening under tension; the other loop of the pair of loops being securable to the forearm of the archer'-string arm proximate the elbow for tightening under tension; said loops cooperating together with said slip loop upon tightening under tension to prevent shifting of the string arm connector with respect to the upper arm and forearm proximate the elbow of the string arm; a draw force carrying member extending rearwardly from an anchor point to the string arm connector; a first adjuster that secures the draw force carrying member to the string arm connector and adjusts the length of the draw force carrying member between the anchor point and the string arm connector; an anchor point connector secured to the draw force carrying member at the anchor point, the draw force carrying member having a front portion that extends forwardly from the anchor point connector; and an elastic-like chord connected to the front portion of the draw force carrying member, the chord extending under tension and, upon release, returning to its relaxed dimensions, such that tensioning of the chord upon use of the device positions the archer'bow hand, string arm, shoulders, and the anchor point along a plane of release where the muscles properly hold the bow force with positioning that maintains the bow hand and the anchor point against movement that would adversely affect accuracy upon string release during actual shooting.

24. An archery aid for providing an archer with proper muscular control and body positioning, the archery aid comprising: a string arm connector located adjacent the elbow of the string arm, said string arm connector including a strap having a slip loop through which the strap extends and defining a pair of loops connected to the slip loop for positioning above and below the elbow; one loop of the pair of loops being securable to the upper arm of the archer'string arm proximate the elbow for tightening under tension; the other loop of the pair of loops being securable to the forearm of the archer'string arm proximate the elbow from tightening under tension; said pair of loops cooperating together with said slip loop upon tightening under tension to prevent shifting of the string arm connector with respect to the upper ar and forearm proximate the elbow of the string arm; a draw force carrying member extending from the string arm connector to an anchor point to position the archer'bow hand, string arm, and shoulders and the anchor point along a plane of release where the muscles properly hold the bow force with positioning that maintains the bow hand and the anchor point against movement that would adversely affect accuracy upon string release during actual shooting; and a hook secured to the draw force carrying member at a anchor point to secure a bow string.

* * * * *

UNITED STATES PATENT AND TRADEMARK OFFICE

CERTIFICATE OF CORRECTION

PATENT NO. : 4,887,584

DATED : December 19, 1989

INVENTOR(S) : RICHARD F. CARELLA

It is certified that error appears in the above-identified patent and that said Letters Patent is hereby corrected as shown below:

Column 1, Line 29, after "shooting" insert a --.--.

Column 2, Line 7, "place" should be --plane--.

Column 2, Line 59, "connection" should be --connector--.

Column 9, Line 67 (Claim 1), after "below" insert --the elbow--.

Column 10, Line 2 (Claim 1), "archer'-" should be --archer's--.

Column 10, Line 7 (Claim 1), "ar" should be --arm--.

Column 10, Line 11 (Claim 1), "archer'bow" should be --archer's bow--.

Column 10, Line 21 (Claim 3), delete "and" and insert --said--.

Column 10, Line 24 (Claim 3), "a" should be --arm--.

Column 10, Line 26 (Claim 3), "archer'upper" should be --archer's upper--.

Column 10, Line 30 (Claim 4), delete "a first" and insert --an--.

Column 10, Line 43 (Claim 8), after "claim" insert --7--.

Column 11, Line 20 (Claim 17), "archer'string" should be --archer's string--.

Column 11, Line 23 (Claim 17), "archer'string" should be --archer's string--.

UNITED STATES PATENT AND TRADEMARK OFFICE

CERTIFICATE OF CORRECTION

PATENT NO. : 4,887,584

DATED : December 19, 1989

INVENTOR(S) : RICHARD F. CARELLA

It is certified that error appears in the above-identified patent and that said Letters Patent is hereby corrected as shown below:

Column 11, Line 27 (Claim 17), "forea" should be --forearm--.

Column 11, Line 33 (Claim 17), "archer'bow" should be --archer's bow--.

Column 11, Line 43 (Claim 18), after "arm" insert a --,--.

Column 11, Line 48 (Claim 18), "archer'string" should be --archer's string--.

Column 11, Line 58 (Claim 18), "archer'-" should be --archer's--.

Column 12, Line 5 (Claim 19), "archer'string" should be --archer's string--.

Column 12, Line 8 (Claim 19), "archer'string" should be --archer's string--.

Column 12, Line 22 (Claim 19), "archer'bow" should be --archer's bow--.

Column 14, Line 14 (Claim 24), "archer'string" should be --archer's string--.

Column 14, Line 17 (Claim 24), "archer'string" should be --archer's string--.

Column 14, Line 21 (Claim 24), "ar" should be --arm--.

UNITED STATES PATENT AND TRADEMARK OFFICE

CERTIFICATE OF CORRECTION

PATENT NO. : 4,887,584

DATED : December 19, 1989

INVENTOR(S) : Richard F. Carella

It is certified that error appears in the above-identified patent and that said Letters Patent is hereby corrected as shown below:

Column 14, Line 24 (Claim 24), "archer'bow" should be --archer's bow--.

Signed and Sealed this

Twenty-eighth Day of January, 1992

*Attest:*

HARRY F. MANBECK, JR.

*Attesting Officer*

*Commissioner of Patents and Trademarks*